US007458232B2

(12) United States Patent
Paradowski

(10) Patent No.: US 7,458,232 B2
(45) Date of Patent: Dec. 2, 2008

(54) METHOD AND INSTALLATION FOR PRODUCING TREATED NATURAL GAS, A C3+ HYDROCARBON CUT AND AN ETHANE RICH STREAM

(75) Inventor: Henri Paradowski, Cergy (FR)

(73) Assignee: Technip France (FR)

( * ) Notice: Subject to any disclaimer, the term of this patent is extended or adjusted under 35 U.S.C. 154(b) by 360 days.

(21) Appl. No.: 11/316,083

(22) Filed: Dec. 21, 2005

(65) Prior Publication Data

US 2006/0144081 A1 Jul. 6, 2006

(30) Foreign Application Priority Data

Dec. 22, 2004 (FR) ..... 04 13751

(51) Int. Cl.
*F25J 3/00* (2006.01)

(52) U.S. Cl. ..... 62/631; 62/628; 62/630

(58) Field of Classification Search ..... 62/630, 62/631, 628
See application file for complete search history.

(56) References Cited

U.S. PATENT DOCUMENTS 3,656,312 A * 4/1972 Streich ..... 62/630
4,368,061 A * 1/1983 Mestrallet et al. ..... 62/630
4,529,484 A * 7/1985 Ryan ..... 203/2
6,116,050 A 9/2000 Yao et al. ..... 62/630
6,368,385 B1 4/2002 Paradowski ..... 95/181
6,516,631 B1 * 2/2003 Trebble ..... 62/630
7,051,553 B2 * 5/2006 Mak et al. ..... 62/636
2003/0029190 A1 2/2003 Trebble ..... 62/620

OTHER PUBLICATIONS

Pitman R. N. et al. "Next generation processes for NGL/LPG Recovery".
French Searc Report FR0413751 dated Jul. 15, 2005.

* cited by examiner

*Primary Examiner*—William C Doerrler
(74) *Attorney, Agent, or Firm*—Ostrolenk, Faber, Gerb & Soffen, LLP

(57) ABSTRACT

This method comprises the cooling of the initial natural gas and its introduction into a column for recovering $C_2^+$ hydrocarbons. It comprises the recovery of the top stream from the column to form the treated natural gas, and the recovery of the bottom stream from the column for introducing it at a feed level of a fractionating column equipped with a top condenser. The column produces the said $C_3^+$ hydrocarbons at the bottom. The method comprises the recovery of the ethane rich stream from an intermediate level of the column located above the said feed level and the production of a secondary reflux stream from the said top condenser refluxed to the top of the recovery column.

15 Claims, 1 Drawing Sheet

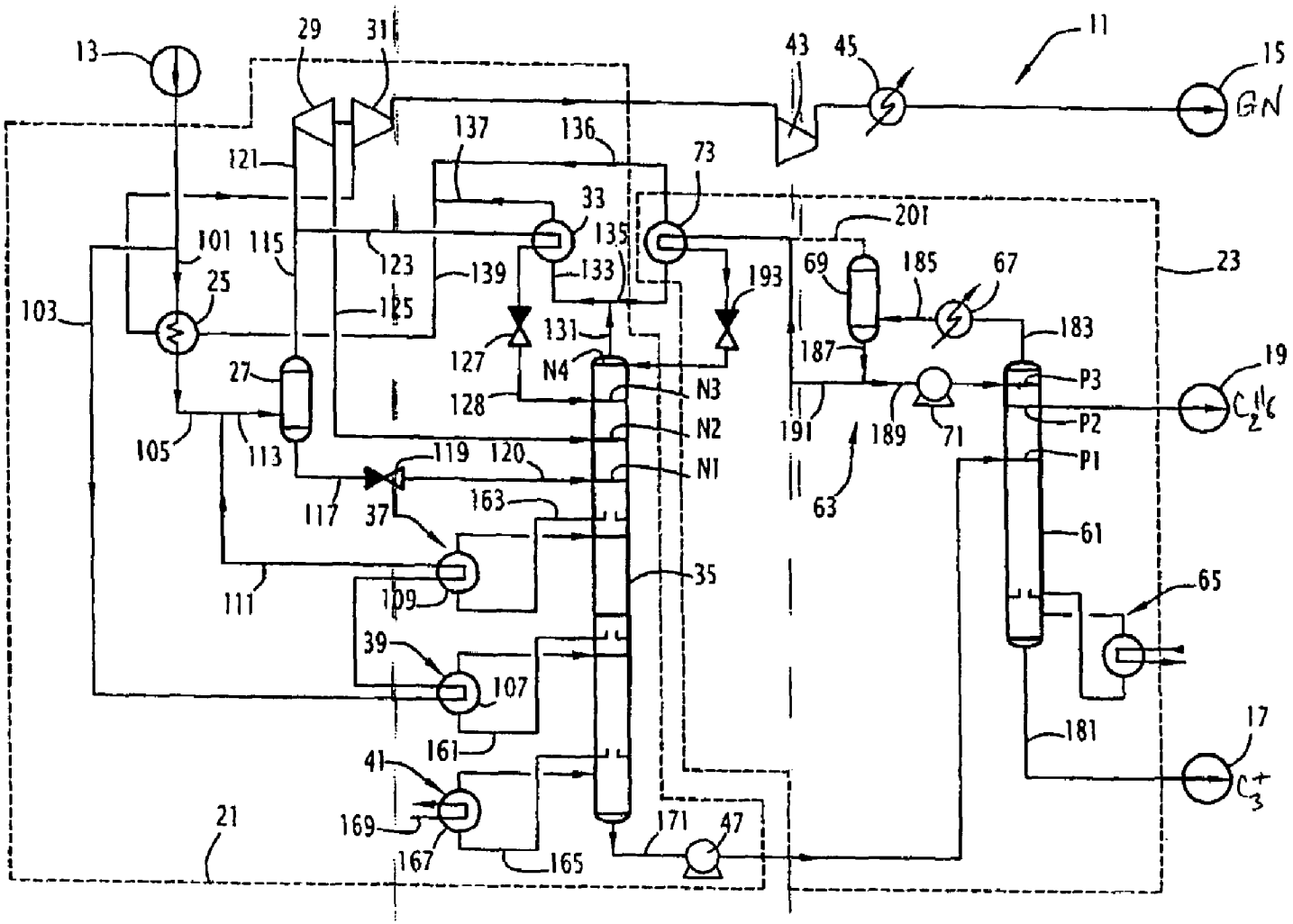
GN
$C_2H_6$
$C_3^+$
P1
P2
P3
N1
N2
N3
N4

METHOD AND INSTALLATION FOR PRODUCING TREATED NATURAL GAS, A C3+ HYDROCARBON CUT AND AN ETHANE RICH STREAM

The present invention relates to a method for simultaneously producing treated natural gas, a $C_3^+$ hydrocarbon rich cut and, in at least certain production conditions, an ethane rich stream, from an initial natural gas comprising methane, ethane and $C_3^+$ hydrocarbons, the method comprising the following steps:

the initial natural gas is cooled and partially condensed;

the cooled natural gas is separated into a liquid stream and a gas stream;

the liquid stream is expanded and introduced into a column for recovering the $C_2^+$ hydrocarbons at a first intermediate level;

the gas stream is separated into a feed stream for the said column and a reflux stream;

the feed stream is expanded in a turbine and introduced into the column at a second intermediate level;

the reflux stream is cooled and at least partially condensed and, after expansion, introduced into the column at a third intermediate level;

the top stream is recovered from the column to form the treated natural gas, and the bottom stream is recovered from the column to form a $C_2^+$ hydrocarbon rich liquid stream;

the said bottom stream is introduced at a feed level of a fractionating column equipped with a top condenser, the fractionating column producing the ethane rich stream at the top and the said $C_3^+$ hydrocarbon cut at the bottom; and a primary reflux stream produced in the top condenser is refluxed to the fractionating column.

The method of the present invention applies to installations for producing, from a natural gas extracted from the subsoil, a treated natural gas, optionally to be liquefied, a $C_3^+$ hydrocarbon cut, and an ethane rich stream at a variable flow rate.

The article "Next Generation Processes for NGL/LPG Recovery" by Wilkinson et al, presented at the "77$^{th}$ Convention of the Gas Processor Association", Dallas, USA, on 16 Mar. 1998, and at the "GPA Europe Annual Conference" Rome, Italy, on 25 Sep. 2002, reports a method of the above type, designated by the term "Gas Subcooled Process" (GSP).

The method of the above type is optimized for simultaneously extracting nearly all the $C_3^+$ hydrocarbons in the initial natural gas, and a high proportion of ethane from the initial gas. Thus, when the ethane extraction rate is at least 70%, the propane extraction rate is close to 99%.

As is well known, the term "extraction rate" means the ratio of the difference between the molar flow rate of a component in the initial natural gas and the molar flow rate of the component in the treated natural gas produced, to the molar flow rate of the component in the initial natural gas.

Such a method is not fully satisfactory. In fact, the ethane demand on the market fluctuates widely, whereas demand for $C_3^+$ hydrocarbon cuts remains relatively constant and well utilized. It is therefore sometimes necessary to decrease the production of ethane in the method, by reducing the extraction rate of this compound in the recovery column. In this case, the $C_3^+$ hydrocarbon extraction rate also decreases, thereby reducing the profitability of the installation.

To overcome this problem, the above article (see FIGS. 15 and 16) proposes to install, in the existing installation, a secondary unit optimized for producing $C_3^+$ hydrocarbons when ethane extraction is low or nil. The operator of the installation then, according to the quantity of ethane required, selectively sends the initial natural gas to the optimized unit for high ethane extraction rates or to the optimized unit for low or zero ethane extraction rates. The method is therefore complex to implement and costly, particularly due to the maintenance costs of the installation in which it is implemented.

It is an object of the invention to provide a method of the above type, that uses simple, inexpensive means to extract substantially all the $C_3^+$ hydrocarbons from an initial natural gas stream, irrespective of the quantity of ethane produced by the method.

For this purpose, the subject of the invention is a method of the above type, characterized in that the ethane rich stream is withdrawn from an intermediate level of the fractionating column located above the said feed level of the column; and in that, for ethane extraction rates lower than a preset threshold, at least one secondary reflux stream is produced from the said top condenser, and the said secondary reflux stream is refluxed to the top of the recovery column.

The method according to the invention may comprise one or more of the following features, considered separately or in all possible combinations:

the flow rate of the ethane rich stream is controlled by adjusting the flow rate of the secondary reflux stream and by adjusting the pressure of the recovery column;

the fractionating column comprises between 1 and 7 theoretical trays above the said intermediate level;

the secondary reflux stream is cooled by heat exchange with at least a first part of the top stream from the recovery column;

the reflux stream from the recovery column is cooled by heat exchange with at least a second part of the top stream from the recovery column;

the secondary reflux stream is produced from a mixture of a gas stream and a liquid stream issuing from the top condenser;

the maximum methane and propane content of the ethane rich stream is controlled using a bottom reboiler mounted on the recovery column;

the $C_5^+$ hydrocarbon content of the treated natural gas is lower than 1 ppm.

A further subject of the invention is an installation for simultaneously producing treated natural gas and a $C_3^+$ hydrocarbon rich cut and, in at least certain production conditions, an ethane rich stream, from an initial natural gas comprising methane, ethane and $C_3^+$ hydrocarbons, the installation comprising:

means for cooling and partially condensing the initial natural gas;

means for separating the cooled natural gas to form a liquid stream and a gas stream;

a column for recovering the $C_2^+$ hydrocarbons;

means for expanding and introducing t he liquid stream into the recovery column, terminating at a first intermediate level for the column; and means for separating the gas stream to form a feed stream for the column and a reflux stream;

a turbine for expanding the feed stream, and means for introducing the stream issuing from the turbine at a second intermediate level of the recovery column;

means for cooling and at least partially condensing the reflux stream terminating in means for expanding the cooled reflux stream, means for in troducing the cooled reflux stream issuing from the means for expanding the cooled reflux stream, at a third level of the recovery column;

means for recovering the top stream from the column to form the treated natural gas;

means for recovering the bottom stream from the column to form a $C_2^+$ hydrocarbon rich liquid stream;

a fractionating column equipped with a top condenser;

means for introducing the said bottom stream at a feed level of the fractionating column;

means for recovering the ethane rich stream, located at the top of the fractionating column, and means for recovering the said $C_3^+$ hydrocarbon cut located at the bottom of the fractionating column; and means for refluxing a primary reflux stream produced in the top condenser to the fractionating column;

characterized in that the means for recovering an ethane rich stream are tapped off at an intermediate level of the fractionating column located above the said feed level of this column;

and in that the installation comprises means for producing, at ethane extraction rates from the initial natural gas lower than a preset threshold, a secondary reflux stream issuing from the top condenser, and means for refluxing this secondary reflux stream to the recovery column.

The installation according to the invention may comprise one or more of the following features, considered separately or in all technically possible combinations:

it comprises means for controlling the flow rate of the ethane rich stream comprising means for adjusting the flow rate of the secondary reflux stream and means for adjusting the pressure in the recovery column;

the fractionating column comprises between 1 and 7 theoretical trays above the said intermediate level;

it comprises means for cooling the secondary reflux stream causing heat exchange between this stream and at least part of the top stream from the recovery column;

it comprises means for cooling the reflux stream from the recovery column causing heat exchange between this stream and at least part of the top stream from the recovery column;

the means for producing the secondary reflux stream comprise means for mixing a gas stream and a liquid stream issuing from the top condenser; and it comprises means for controlling the maximum methane and propane content of the ethane rich stream comprising a bottom reboiler mounted on the recovery column.

Examples of embodiments of the invention will now be described with respect to the single appended FIGURE.

The FIGURE shows a functional block diagram of an installation according to the invention.

The installation 11 shown in the FIGURE is suitable for using a source 13 of initial desulphurized, dried and at least partially decarbonated natural gas, for simultaneously producing a treated natural gas 15 as a main product, a $C_3^+$ hydrocarbon cut 17, and an ethane rich stream 19, at an adjustable flow rate.

The term "at least partially decarbonated" means that the carbon dioxide content of the initial gas 13 is advantageously lower than or equal to 50 ppm when the treated natural gas 15 is to be liquefied. This content is advantageously lower than 3% when the treated natural gas 15 is sent directly to a gas distribution network.

This installation 11 comprises a unit 21 for recovering the $C_2^+$hydrocarbons, and a unit 23 for fractionating these $C_2^+$ hydrocarbons.

In the following description, the same numeral is used to denote a liquid stream and the line that conveys it, the pressures considered are absolute pressures, and the percentages considered are mole percentages.

The $C_2^+$ hydrocarbon recovery unit 21 comprises successively, downstream of the source 13, a first heat exchanger 25, a first separator drum 27, a turbine 29 coupled with a first compressor 31, a first top heat exchanger 33, and a recovery column 35 equipped with an upper side reboiler 37, a lower side reboiler 39 and a bottom reboiler 41.

The unit 21 further comprises a second compressor 43 driven by an outside energy source, and a first cooler 45. The unit 21 also comprises a column bottom pump 47.

The fractionating unit 23 comprises a fractionating column 61. The column 61 comprises a top condenser 63 at the top, and a reboiler 65 at the bottom.

The top condenser 63 comprises a second cooler 67 and a second separator drum 69 associated with a reflux pump 71 and with a second top heat exchanger 73 of the column 35.

An example of an embodiment of the method according to the invention will now be described.

The initial molar composition of the desulphurized, dried, and at least partially decarbonated initial natural gas stream 13, is given in Table 1 below.

TABLE 1

| | Molar fraction in % |
|---|---|
| Helium | 0.0713 |
| $CO_2$ | 0.0050 |
| Nitrogen | 1.2022 |
| Methane | 85.7828 |
| Ethane | 10.3815 |
| Propane | 2.1904 |
| i-butane | 0.1426 |
| n-butane | 0.1936 |
| i-pentane | 0.0204 |
| n-pentane | 0.0102 |
| Hexane | 0.0000 |
| Total | 100.0000 |

The initial gas 13 is separated into a main stream 101 and a secondary stream 103. The ratio of the flow rate of the secondary stream 103 to the flow rate of initial gas 13 is, for example, between 20% and 40%.

The main stream 101 is cooled in the first heat exchanger 25 to form a cooled gas stream 105. The secondary stream 103 is cooled successively in respective heat exchangers 107, 109 of the lower 39 and upper 37 side reboilers, to form a cooled secondary stream 111 which is mixed with the cooled main stream 105.

The mixture 113 obtained is introduced into the separator drum 27 where it is separated into a gas phase 115 and a liquid phase 117. The liquid phase 117, after passage through a relief valve 119, forms an expanded liquid phase 120 that is introduced at a first intermediate level N1 of the recovery column 35 located in the upper portion of the column, above the side reboilers 37 and 39. "Intermediate level" means a location comprising distillation means above and below this level.

The gas fraction 115 is separated into a feed stream 121 and a reflux stream 123. The feed stream 121 is expanded in the turbine 29 to produce an expanded feed stream 125, which is introduced into the recovery column 35 at a second intermediate level N2, located above the first intermediate level N1.

The reflux stream 123 is partially condensed in the first top heat exchanger 33, and then expanded in a relief valve 127, to form an expanded reflux stream 128. This stream 128 is introduced into the recovery column 35 at a third intermediate level N3, located above the intermediate level N2.

The pressure of the recovery column 35 is, for example, between 15 and 40 bar.

The recovery column 35 produces a t op stream 131 that is separated into a majority fraction 133 and a minority fraction 135. The majority fraction 133 is heated in the first top heat exchanger 33 by heat exchange with the reflux stream 123 to form a heated majority fraction 137. The ratio of the flow rate of the minority fraction 135 to the majority fraction 133 is, for example, lower than 20%.

The minority fraction 135 is heated in the second top heat exchanger 73 to form a heated fraction 136. This fraction 136 is mixed with the heated majority fraction 137 to form a heated treated gas stream 139.

This stream 139 is again heated in the first heat exchanger 25 by heat exchange with the main stream 101 of the pretreated natural gas.

The heated treated natural gas 139 is then compressed in the first compressor 31, then in the second compressor 43, and cooled in the first cooler 45 to form the treated natural gas 15.

The treated gas 15 contains 0.0755 mol % of helium, 0.0049% of carbon dioxide, 1.2735 mol % of nitrogen, 90.8511 mol % of methane, 7.7717 mol % of $C_2^+$ hydrocarbons, 0.0232 mol % of $C_3$ hydrocarbons, and a $C_4$ hydrocarbon content lower than 1 ppm. This treated gas comprises a $C_6^+$ hydrocarbon content lower than 1 ppm, a moisture content lower than 1 ppm, advantageously lower than 0.1 ppm, a sulphur dioxide content lower than 4 ppm, and a carbon dioxide content lower than 50 ppm. The treated gas 15 can therefore be sent directly to a liquefaction train to produce liquefied natural gas.

Reboiler streams 163, 161 are extracted from the column 35 and reintroduced into the column 35 after heating in the respective heat exchangers 109, 107 of the upper and lower reboilers 37 and 39, by heat exchange with the minority stream 111 of the entering natural gas.

A bottom reboiler stream 165 is extracted in the neighbourhood of the bottom of the column 35. This stream 165 passes through a bottom heat exchanger 167 in which it is heated by heat exchange with a heating stream 169 at adjustable temperature. The heated reboiler stream is then reintroduced into the column 35.

A bottom stream 171 rich in $C_2^+$ hydrocarbons is extracted from the bottom of the fractionating column 35 to form a $C_2^+$hydrocarbon cut.

The bottom stream 171 is pumped by the tank bottom pump 47 to an intermediate level P1 of the fractionating column 61.

In the example shown, the fractionating column 61 operates at a pressure of between 20 and 42 bar. In this example, the pressure of the fractioning column 61 is at least one bar higher than the pressure of the recovery column 35.

A bottom stream 181 is extracted from the fractionating column 61 to form the $C_3^+$ hydrocarbon cut 17.

The $C_3^+$ hydrocarbon extraction rate in the method is higher than 99%. In all cases, the propane extraction rate is higher than 99% and the $C_4^+$ hydrocarbon extraction rate is higher than 99.8%.

The molar ratio of ethane to propane in the cut 17 is lower than 2% and particularly substantially equal to 0.5%.

The ethane rich stream 19 is withdrawn directly a t an intermediate level P2 located in the upper portion of the fractionating column 61.

This stream comprises 0.57% of methane, 97.4% of ethane, 2% of propane and 108 ppm of carbon dioxide.

The number of theoretical trays between the top of the column 61 and the upper level P2 is, for example, between 1 and 7. The level P2 is higher than the feed level P1.

The methane and propane content of the bottom stream 171, and hence of the stream 19, is adjusted in particular by the temperature of the heating stream 169 from the bottom reboiler. These contents are preferably lower than 1% and 2% respectively.

A top stream 183 is extracted from the top of the column 61 and cooled in the second cooler 67 to form a cooled and at least partially condensed top stream 185. This stream 185 is introduced into the second separator drum 69 to produce a liquid fraction 187.

The liquid fraction 187 is then separated into a primary reflux stream 189 and a secondary reflux stream 191.

The primary reflux stream 189 is pumped for refluxing to the fractionating column 35, at a top level P3 located above the level P2.

The secondary reflux stream 191 is introduced into the second top heat exchanger 73, where it is cooled by heat exchange with the stream 135 and then expanded in a valve 193 and refluxed to the top level N4 of the recovery column 35.

The stream 191 contains 1.64% of methane, 97.75% of ethane, 0.59% of propane and 216 ppm of carbon dioxide.

The ethane extraction rate, and hence the ethane flow rate produced in the installation 11, is controlled by adjusting the flow rate of the secondary reflux stream 191 flowing through the relief valve 193, on the one hand, and by adjusting the pressure in the recovery column 35, using the compressors 43 and 31 which are of the variable speed type, on the other.

As shown in Table 2 below, the flow rate of the ethane rich stream is adjustable, practically without affecting the $C_3^+$ hydrocarbon extraction rate.

The method according to the invention is therefore suitable, using simple and inexpensive means, for obtaining a variable and easily adjustable flow rate of an ethane rich stream 19 extracted from the initial natural gas 13, while maintaining the propane extraction rate above 99%. This result is obtained without any significant modification of the installation in which the method is implemented.

TABLE 2

| Column 35 Pressure (bar) | Ethane Extraction Rate (%) | $C_3$ Extraction Rate (%) | $C_4^+$ Extraction Rate (%) | Stream 19 Flow Rate (kg/h) | Total Compression Capacity (kW) |
|---|---|---|---|---|---|
| 28.5 | 0.11 | 99.0 | 100.0 | 0 | 16367 |
| 27.7 | 9.87 | 99.0 | 100.0 | 11961 | 16874 |
| 26.8 | 19.60 | 99.0 | 100.0 | 23888 | 17672 |
| 25.2 | 29.33 | 99.0 | 100.0 | 35830 | 18951 |
| 24.0 | 39.05 | 99.0 | 100.0 | 47759 | 20086 |
| 22.0 | 48.77 | 99.0 | 100.0 | 59697 | 22405 |
| 20.0 | 58.47 | 99.2 | 100.0 | 71626 | 25485 |

The values of the pressures, temperatures and flow rates in the case in which the ethane recovery rate is equal to 29.33% are given in Table 3 below.

| Stream | Flow Rate (kmol/h) | Pressure (bar) | Temperature (° C.) |
|---|---|---|---|
| 13 | 38000 | 50.0 | 20.0 |
| 15 | 35872 | 50.0 | 40.0 |
| 19 | 1183 | 33.5 | 15.9 |
| 111 | 8500 | 49.0 | −30.6 |
| 113 | 38000 | 49.0 | −43.0 |
| 115 | 36690 | 49.0 | −43.0 |
| 120 | 1310 | 25.4 | −60.2 |
| 125 | 31690 | 25.4 | −68.1 |
| 128 | 5000 | 25.4 | −92.8 |
| 131 | 35873 | 24.7 | −75.5 |
| 136 | 1545 | 25.2 | 3.9 |
| 137 | 34328 | 25.2 | −62.5 |

-continued

| Stream | Flow Rate (kmol/h) | Pressure (bar) | Temperature (° C.) |
|---|---|---|---|
| 139 | 35873 | 24.7 | −59.8 |
| 171 | 2856 | 25.4 | 18.3 |
| 181 | 944 | 33.0 | 91.1 |
| 183 | 3581 | 33.0 | 13.7 |
| 191 | 728 | 33.0 | 10.9 |

The composition of the secondary reflux stream 191, which is richer in methane than the ethane stream 19 withdrawn from the fractionating column 61, makes it possible to obtain this result in particular.

Furthermore, if the flow rate of the ethane rich stream 19 reduced, the total compression capacity is also substantially reduced.

Moreover, the recovery of cold in the heat exchangers 107, 109 of the side reboilers 37, 39 of the recovery column 35 are self-adjusting without the need to control the flow rates of fluid passing through these heat exchangers, and irrespective of the flow rate of the ethane rich stream 19 produced.

The installation 11 according to the invention also does not require the indispensable use of multistream heat exchangers. This makes it possible to use shell and tube heat exchangers exclusively, thereby increasing the reliability of the installation and decreasing the risk of plugging.

The treated natural gas 15 comprises substantially zero contents of $C_5^+$ hydrocarbons, for example lower than 1 ppm. Accordingly, if the carbon dioxide content of the treated gas 15 is lower than 50 ppm, this gas 15 can be liquefied without supplementary treatment or fractionation.

In a first variant, shown by a dotted line in the FIGURE, the top stream 183 from the fractionating column is not completely condensed in the cooler 67. The gas stream 201 issuing from the separator drum 69 is then mixed with the secondary reflux stream 191, before passing into the second top heat exchanger 73.

In another variant (not shown), if the pressure of the initial natural gas is very high, for example above 100 bar, the pressure in the recovery column 35 is higher than the pressure in the fractionating column 61. In this case, the bottom stream 171 from the recovery column 35 is conveyed to the fractionating column 61 via a relief valve. Moreover, the secondary reflux stream 191 is then pumped to the top of the recovery column 35.

What is claimed is:

1. Method for simultaneously producing treated natural gas, a $C_3^+$ hydrocarbon rich cut and, in at least certain production conditions, an ethane rich stream, from an initial natural gas comprising methane, ethane and $C_3^+$ hydrocarbons, the method comprising the following steps:

the initial natural gas is cooled and partially condensed;

the cooled natural gas is separated into a liquid stream and a gas stream;

the liquid stream is expanded and introduced into a recovery column for recovering the $C_2^+$ hydrocarbons at a first intermediate level;

the gas stream is separated into a feed stream for the said column and a reflux stream;

the feed stream is expanded in a turbine and introduced into the column at a second intermediate level;

the reflux stream is cooled and at least partially condensed and, after expansion, introduced into the column at a third intermediate level;

the top stream is recovered from the column to form the treated natural gas, and the bottom stream is recovered from the column to form a $C_2^+$ hydrocarbon rich liquid stream;

the said bottom stream is introduced at a feed level of a fractionating column equipped with a top condenser, the top condenser comprising a separator drum producing a liquid fraction, the fractionating column producing the ethane rich stream at the top and the said $C_3^+$ hydrocarbon cut at the bottom; and a primary reflux stream produced in the top condenser is refluxed to the fractionating column;

wherein that the ethane rich stream is withdrawn from an intermediate level of the fractionating column located above the said feed level of this column;

and in that, for ethane extraction rates lower than a preset threshold, at least one secondary reflux stream is produced from the said top condenser by separation of the liquid fraction into the primary reflux stream and the secondary reflux stream and the said secondary reflux stream produced by separation of the liquid fraction is refluxed to the top of the recovery column.

2. Method according to claim 1, wherein that the flow rate of the ethane rich stream is controlled by adjusting the flow rate of the secondary reflux stream and by adjusting the pressure of the recovery column.

3. Method according to claim 1, wherein that the fractionating column comprises between 1 and 7 theoretical trays above the said intermediate level.

4. Method according to claim 1, wherein in that the secondary reflux stream is cooled by heat exchange with at least a first part of the top stream from the recovery column.

5. Method according to claim 4, wherein that the reflux stream from the recovery column is cooled by heat exchange with at least a second part of the top stream from the recovery column.

6. Method according to claim 1, wherein that the secondary reflux stream is produced from a mixture of a gas stream and a liquid stream issuing from the top condenser.

7. Method according to claim 1, wherein that the maximum methane and propane content of the ethane rich stream is controlled using a bottom reboiler mounted on the recovery column.

8. Method according to claim 1, wherein that the $C_5^+$ hydrocarbon content of the treated natural gas is lower than 1 ppm.

9. Installation for simultaneously producing treated natural gas and a $C_3^+$ hydrocarbon rich cut and, in at least certain production conditions, an ethane rich stream, from an initial natural gas comprising methane, ethane and $C_3^+$ hydrocarbons, the installation comprising:

means for cooling and partially condensing the initial natural gas;

means for separating the cooled natural gas to form a liquid stream and a gas stream;

a recovery column for recovering the $C_2^+$ hydrocarbons;

means for expanding and introducing the liquid stream into the recovery column, terminating at a first intermediate level of the column; and means for separating the gas stream to form a feed stream for the column and a reflux stream;

a turbine for expanding the feed stream, and means for introducing the stream issuing from the turbine at a second intermediate level of the recovery column;

means for cooling and at least partially condensing the reflux stream terminating in means for expanding the cooled reflux stream, means for introducing the cooled reflux stream issuing from the means for expanding the cooled reflux stream, at a third level of the recovery column;

means for recovering the top stream from the column to form the treated natural gas;

means for recovering the column bottom stream to form a $C_2^+$ hydrocarbon rich liquid stream;

a fractionating column equipped with a top condenser, the top condenser comprising a separator drum producing a liquid fraction;

means for introducing the said bottom stream at a feed level of the fractionating column;

means for recovering the ethane rich stream, located at the top of the fractionating column, and means for recovering the said $C_3^+$ hydrocarbon cut located at the bottom of the fractionating column; and means for refluxing a primary reflux stream produced in the top condenser to the fractionating column;

wherein that the means for recovering an ethane rich stream are tapped off at an intermediate level of the fractionating column located above the said feed level of this column;

and in that the installation comprises means for producing, at ethane extraction rates from the initial natural gas lower than a preset threshold, a secondary reflux stream issuing from the top condenser by separation of the liquid fraction into the primary reflux stream and the secondary reflux stream, and means for refluxing this secondary reflux stream produced by separation of the liquid fraction to the recovery column.

10. Installation according to claim 9, wherein that it comprises means for controlling the flow rate of the ethane rich stream comprising means for adjusting the flow rate of the secondary reflux stream and means for adjusting the pressure in the recovery column.

11. Installation according to claim 9, wherein that the fractionating column comprises between 1 and 7 theoretical trays above the said intermediate level.

12. Installation according to claim 9, wherein that it comprises means for cooling the secondary reflux stream causing heat exchange between this stream and at least part of the top stream from the recovery column.

13. Installation according to claim 12, wherein that it comprises means for cooling the reflux stream from the recovery column causing heat exchange between this stream and at least part of the top stream from the recovery column.

14. Installation according to claim 9, wherein that the means for producing the secondary reflux stream comprise means for mixing a gas stream and a liquid stream issuing from the top condenser.

15. Installation according to any one of claim 9, wherein that it comprises means for controlling the maximum methane and propane content of the ethane rich stream comprising a bottom reboiler mounted on the recovery column.

* * * * *